US010717629B2

(12) United States Patent
Vakkamäki et al.

(10) Patent No.: US 10,717,629 B2
(45) Date of Patent: Jul. 21, 2020

(54) SOLUTION FOR MONITORING AN ELEVATOR BRAKE

(71) Applicant: KONE Corporation, Helsinki (FI)

(72) Inventors: Henri Vakkamäki, Helsinki (FI); Janne Rossi, Helsinki (FI); Timo Korhonen, Helsinki (FI); Zhizhong Yan, Helsinki (FI)

(73) Assignee: KONE CORPORATION, Helsinki (FI)

( * ) Notice: Subject to any disclaimer, the term of this patent is extended or adjusted under 35 U.S.C. 154(b) by 347 days.

(21) Appl. No.: 15/485,832

(22) Filed: Apr. 12, 2017

(65) Prior Publication Data

US 2017/0313550 A1 Nov. 2, 2017

(30) Foreign Application Priority Data

Apr. 28, 2016 (EP) ..... 16167492

(51) Int. Cl.

| | |
|---|---|
| ***B66B 5/00*** | (2006.01) |
| ***B66B 1/32*** | (2006.01) |
| ***B66B 1/36*** | (2006.01) |
| ***B66B 3/00*** | (2006.01) |
| ***B66B 5/02*** | (2006.01) |

(52) U.S. Cl.

CPC ..... *B66B 5/0031* (2013.01); *B66B 1/32* (2013.01); *B66B 1/36* (2013.01); *B66B 3/00* (2013.01); *B66B 5/00* (2013.01); *B66B 5/0025* (2013.01); *B66B 5/02* (2013.01)

(58) Field of Classification Search

USPC ..... 187/390

See application file for complete search history.

(56) References Cited

U.S. PATENT DOCUMENTS

| | | | | |
|---|---|---|---|---|
| 8,011,481 | B2 * | 9/2011 | Erny | B66D 5/08 187/393 |
| 2002/0100646 | A1 | 8/2002 | Maurice et al. | |
| 2008/0100646 | A1 | 5/2008 | Suzuki | |

FOREIGN PATENT DOCUMENTS

| | | | |
|---|---|---|---|
| CN | 101169915 | A | 4/2008 |

* cited by examiner

*Primary Examiner* — Christopher Uhlir

(74) *Attorney, Agent, or Firm* — Birch, Stewart, Kolasch & Birch, LLP

(57) ABSTRACT

The present invention relates to a machinery brake for an elevator. The machinery brake comprises a frame part comprising an electromagnet and an armature part, wherein the machinery brake further comprising an inductive proximity sensor mounted to one of the following: the frame part, the armature part and a target mounted to the other of the following: the frame part, armature part. The inductive proximity sensor and the target are mounted with respect to each other so that in a normal state of the machinery brake the target resides within an operational area of the inductive proximity sensor and in an abnormal state of the machinery brake the target resides at least partly outside the operational area of the inductive proximity sensor. The invention also relates to a method therein.

20 Claims, 5 Drawing Sheets

SOLUTION FOR MONITORING AN ELEVATOR BRAKE

TECHNICAL FIELD

The invention concerns in general the technical field of elevators. More particularly, the invention concerns a monitoring solution of a machinery brake in an elevator.

BACKGROUND

An elevator comprises an elevator hoisting machine into which a machinery brake is implemented. The machinery brake engages mechanically with a rotating part of the hoisting machine causing the braking effect. The machinery brake may e.g. be a shoe brake, a drum brake or a disc brake.

A structure of the machinery brake is typically such that it comprises an armature part provided with a brake pad and a frame part comprising an electromagnet. Between the armature part and the frame part is arranged one or more springs. The operation of the machinery brake is based on a utilization of the springs that are arranged to push the armature part provided with a brake pad against the braking surface of a rotating part of the hoisting machine in order to achieve the braking effect i.e. holding the elevator car stationary in the shaft when the control of the motor is inactivated. By means of the electromagnet when provided with an electric current it is possible to pull a magnetic core of the armature part, and thus the armature part, against the spring force of the springs so that the brake may be released away from the braking surface. Hence, the control of the machinery brake between the activated and inactivated states may be achieved by controlling the current supply of the electromagnet and, thus, the force of attraction of the electromagnet may be controlled.

As is clear the machinery brake of an elevator hoisting machine is under heavy forces when used. Additionally, the elevator is affected by great number of environmental variables, such as constant change in load, vibration caused by the hoisting motor among others, thermal expansion due to ambient temperature and temperature generated by elevator operation. All these have also effect on elevator brake and the elevator parts in general and in the worst case may cause displacement of parts even so that the elevator starts to misoperate or stop operation in full. As regards to elevator brake it is important to detect that the brake parts have such mutual positions that they do not prevent the operation of the elevator brake.

In known solutions so called micro switches are used for detecting mutual positions of at least two objects, and especially a change in positions of the objects. However, the problem in the use of micro switches is that they cannot be used in every application areas because there is no possibility to arrange a space for them and/or the operational environment is such that it prevents the use of the micro switches. For example, an electromagnetic field of the electromagnets may cause challenges in using the micro switches, which is the case in elevator brakes. Moreover, one problem with micro switches is that they are unreliable by default and their accuracy is inadequate in many application areas. For example, in elevator brakes the mutual motion of the armature part and the frame part is in scale of 0.15 mm, but the micro switches cannot detect such a small motion with acceptable reliability. Further, manufacturing of the micro switches is challenging.

Hence, there is need to develop solutions by means of which it is at least partly possible to improve a monitoring of an operational state of elevator brakes.

SUMMARY

The following presents a simplified summary in order to provide basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

An objective of the invention is to present a solution for monitoring an operational state of a machinery brake for elevators. Alternatively or additionally, it is an object of the present invention to provide a solution by means of which the operational state monitoring is achieved by a sophisticated sensor arrangement implemented in the machinery brake.

The objectives of the invention are reached by a machinery brake for an elevator and a method as defined by the respective independent claims.

According to a first aspect, a machinery brake for an elevator is provided, wherein the machinery brake comprises: a frame part comprising an electromagnet, an armature part; wherein the machinery brake further comprising an inductive proximity sensor mounted to one of the following: the frame part, the armature part and a target mounted to the other of the following: the frame part, armature part, wherein the inductive proximity sensor and the target are mounted with respect to each other so that in a normal state of the machinery brake the target resides within an operational area of the inductive proximity sensor and in an abnormal state of the machinery brake the target resides at least partly outside the operational area of the inductive proximity sensor.

The proximity sensor may be configured to generate a first output signal when the machinery brake is in the normal state and a second output signal when the machinery brake is in the abnormal state.

The target may comprise a planar surface facing the proximity sensor wherein the planar surface is arranged perpendicularly to a center axis of a coil in the proximity sensor. A boundary defining the planar surface of the target may comprise rounded shapes. The planar surface may be a circle.

Further, a ratio of an outer diameter of the coil with respect to a shortest diameter of the target surface may be 1:3.

The inductive proximity sensor and the target may be mounted with the respective parts so that a direction of a central axis of a coil residing in the inductive proximity sensor deviates from a normal of the surface of the armature part facing the frame part.

The target may be brought to the operational area of the inductive proximity sensor through a through hole arranged in the part into which the inductive proximity sensor is mounted to.

The target may at least partly be made of ferromagnetic material.

The machinery brake may further comprise a control unit that is configured to generate an alarm signal in response to a detection that the machinery brake is in the abnormal state.

According to a second aspect, a method for monitoring an operational state of a machinery brake of an elevator is provided, wherein the machinery brake comprises a frame part comprising an electromagnet and an armature part, the method comprising: monitoring an output signal of an inductive proximity sensor that is mounted to one of the following: the frame part, the armature part wherein the output signal is dependent on a mutual position of the inductive proximity sensor and a target mounted to the other of the following: the frame part, armature part; and in response to detection that the output signal of the inductive proximity sensor is changed a control unit of the machinery brake is configured to generate an alarm signal.

Various exemplifying and non-limiting embodiments of the invention both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of unrecited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

The embodiments of the invention are illustrated by way of example, and not by way of limitation, in the figures of the accompanying drawings.

DESCRIPTION OF THE EXEMPLIFYING EMBODIMENTS

The specific examples provided in the description given below should not be construed as limiting the scope and/or the applicability of the appended claims. Lists and groups of examples provided in the description given below are not exhaustive unless otherwise explicitly stated.

The present invention is at least partly based on a utilization of at least one proximity sensor in elevator solutions and especially in a machinery brake of the elevator. The proximity sensor is a type of sensor that is configured to detect a presence or an absence of a target within an operational area of the sensor. There are different types of proximity sensors available. For example, the operation of the proximity sensors may be based on a capacitance between the sensor and the target or an inductance between the sensor and the target. Further, photoelectric sensors may also be considered as proximity sensors as a reflection of a transmitted light may be monitored and analyzed in order to detect the presence or the absence of the target. Also other types of proximity sensors are known. A selection of the type of proximity sensor is typically dependent on an application area in which the proximity sensor is applied to. More specifically, the selection depends heavily on a material of the target. As an example, if the target is metal an inductive proximity sensor is applicable.

The proximity sensor, and especially the inductive proximity sensor, comprises an inductive coil made of numerous turns of conductive wire, such as copper, and a capacitor for storing electrical charge. An input current is provided to an oscillator that generates an alternating current to the coil, which, in turn, generates a magnetic field in front of the proximity sensor. Now, when a target made of conductive metal is brought in a zone defined by boundaries of the magnetic field, some of the energy is transferred into the target causing eddy currents flowing in the target surface. Thus, the power loss affects to current flow in the internal LC resonance circuit of the proximity sensor, and when the target moves away from the zone at some point the state of the sensor changes. In other words, the sensor may indicate the presence of the target within the magnetic field for example by outputting a signal and when the target moves enough away from the boundaries of the magnetic field, the proximity sensor changes its state and the output signal is not present anymore.

Figure 1:
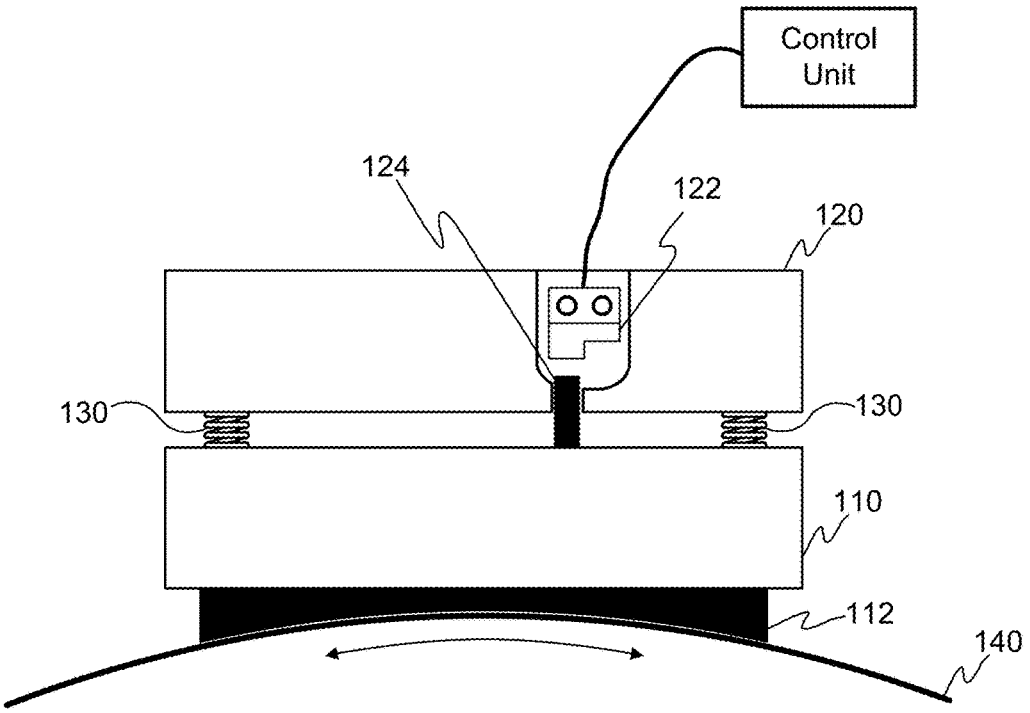
FIG. 1 illustrates schematically a cross-sectional view of a machinery brake according to an embodiment of the invention.

In order to monitor an operational state of the machinery brake, according to an embodiment of the invention, an inductive proximity sensor is arranged in the machinery brake as schematically illustrated in FIG. 1 that illustrates a cross-sectional view of a machinery brake according to an embodiment of the invention. The machinery brake, as illustrated, comprises an armature part 110, a frame part 120 and a number of springs 130 arranged between the armature part 110 and the frame part 120. The springs may be mounted either to the armature part 110 or the frame part 120 or both. The frame part 120 comprises an electromagnet having a coil and by supplying electric current to the coil of the electromagnet a magnetic field may be generated. As the armature part 110 comprises a core of magnetic material the armature part is pulled towards the frame part 120 when the magnetic field is generated. By dimensioning the springs and the electromagnetic force optimally it is possible to control the triggering of the machinery brake between an active and an inactive state with the current supplied to the electromagnet. Furthermore, a brake pad 112 may be mounted to the armature part 110 which brake pad 112 is arranged to hit against a braking surface of a rotating part of a hoisting machine 140 in order to hold elevator car stationary if the control of the motor is inactivated. According to an embodiment of the present invention an inductive proximity sensor 122 is arranged in an aperture of the frame part 120. The inductive proximity sensor 122 comprises a coil into which an electric current is supplied in order to generate a magnetic field by means of which it is possible to monitor a position of a target 124 with respect to the proximity sensor 122. The target 124 in this embodiment refers to a metal structure that is mounted, or arranged, to the armature part 110 and that is such in shape that it may intrude to the aperture arranged in the frame part. Moreover, the target 124, in this embodiment, is arranged to intrude through an aperture hole arranged in the frame part 120 so that it reaches an operational distance of the inductive proximity sensor 122. Naturally the target 124 and the proximity sensor 122 are dimensioned and arranged so that the proximity sensor arrangement with the target does not prevent the operation of the machinery brake. The proximity sensor 122 and the target may be mounted to the frame part and the armature part with known methods, like using fixing devices like screws and bolts and/or by welding when applicable. FIG. 1 also illustrates a control unit that is configured to supply current to the proximity sensor, but also to monitor the output of the proximity sensor in order to monitor changes in there.

Figure 2A:
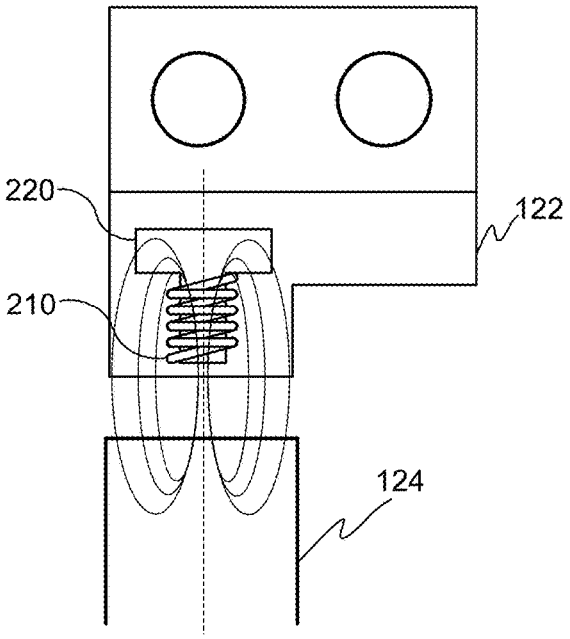
FIGS. 2A and 2B illustrate schematically an inductive proximity sensor as well as the target in different states according to an embodiment of the invention.

FIG. 2A schematically illustrates the inductive proximity sensor 122 in more detail as well as the target 124. As already mentioned the inductive proximity sensor 122 comprises a coil 210, preferably having a magnetic core made of iron or ferrite inside the coil 210. In FIG. 2 the core 220 is T shaped ferrite which is arranged at least partly inside the coil 210 for increasing the magnetic field generated when an alternating current is supplied in the coil. FIG. 2A does not illustrate the needed wiring and other means for supplying the current in the coil in order to maintain clarity in the figure. As said the supplied current to the coil 210 generates a magnetic field that travels to and through the target 124 over an air gap between the proximity sensor 122 and the target (the magnetic field is schematically illustrated as ellipses in FIG. 2A). According to the present invention a target surface i.e. a planar surface of the target 124 facing the proximity sensor 122, and thus the frame part 120, is preferably arranged perpendicularly to a center axis of the coil 210 (illustrated as dashed line in FIG. 2A).

Figure 2B:
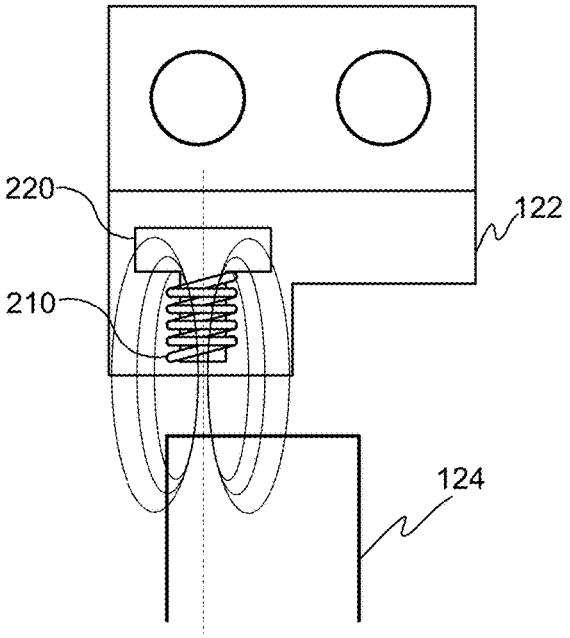

At least some aspects of the present invention relate to a utilization of the arrangement, as illustrated e.g. in FIG. 2A, for monitoring a lateral displacement of the target 124 with respect to the proximity sensor 122, and especially the coil 210 therein. The lateral displacement refers to a situation in which the point on the planar surface of the target 124 through which the imaginary center axis of the coil 210 travels changes due to the lateral displacement of either the target 124 or the proximity sensor 122 (a changed situation is schematically illustrated in FIG. 2B). Naturally the mutual motion may comprise a component representing a displacement in the direction of the center axis of the coil 210. The lateral displacement is important to detect as it may indicate a misoperation of the machinery brake in the elevator.

For sake of clarity one may consider that in FIG. 2A it is illustrated a normal state of a machinery brake and in FIG. 2B it is illustrated a situation in which the machinery brake is in an abnormal state due to a mutual displacement of the frame part and the armature part. The mutual displacement may be a result of displacement of either the frame part or the armature part or both.

Figure 3A:
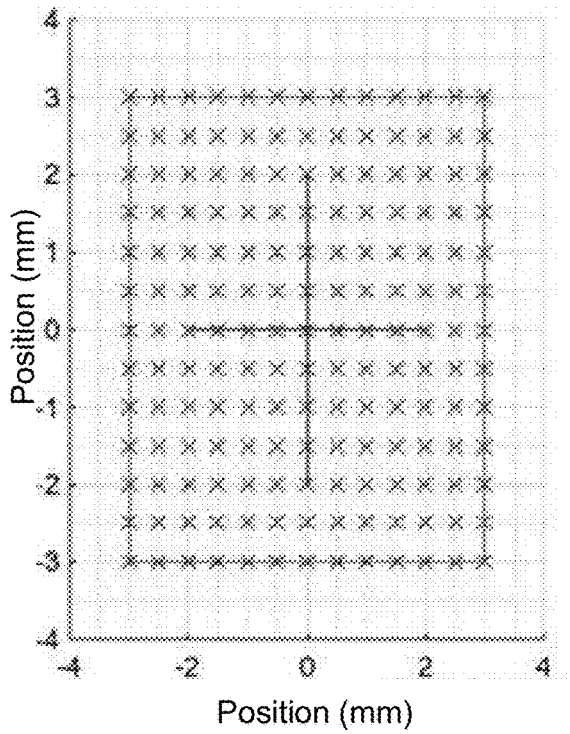
FIGS. 3A and 3B illustrate schematically some aspects of the invention relating to the fundamental idea behind the invention.
Figure 3B:
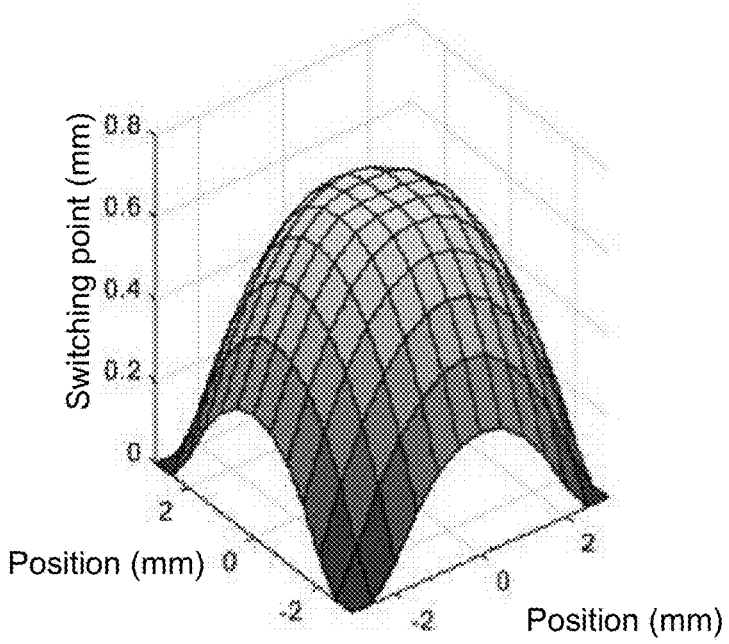

Next the at least some aspects of the invention relating to the monitoring the lateral displacement is described by referring to FIG. 3A and FIG. 3B. Figure schematically illustrates the monitoring of lateral displacement with a help of a coordination system arranged on the target surface wherein the center axis of the coil 210 is considered to travel through the origin (point 0, 0). The coordination system provides a tool for understanding the displacement in predetermined measurement units, such as millimeters.

By combining the coordination system with the switching point consideration in three dimensional space the advantages of the invention may be explained in more detail. As already mentioned the switching point in the context of the inductive proximity sensors refers to a distance between the sensor and the target at which the sensor changes its state due to the fact that magnetic field traveling through the target changes over a limit, i.e. sensor's detection circuit detects a reduced strength in an oscillating magnetic field. The change of the state in sensor refers to output signal from the proximity sensor. FIG. 3B schematically illustrates, as a non-limiting example, a switching point with respect to a coordinate system of FIG. 3A. In other words, from FIG. 3B it is possible to find a switching point with different mutual positions of the target 124 and the proximity sensor 122 in the coordinate system. As may be seen from FIG. 3B when the arrangement is aligned optimally, i.e. there is no lateral deviation or it is minimal, the switching point is much larger than in a situation when the target and the proximity sensor have a larger mutual lateral displacement. The larger mutual lateral displacement causes the switching point to be smaller than in the previous situation. As may also be seen from FIG. 3B the larger a gradient of a tangent plane becomes the larger is the lateral deviation between the mentioned entities and this phenomenon may be used in an application area of elevator brakes, as will be described.

Figure 4:
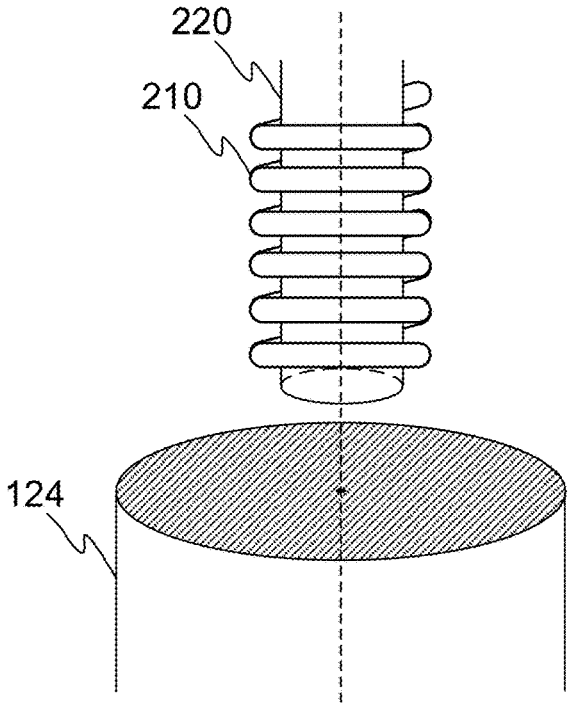
FIG. 4 illustrates schematically some aspects of an embodiment of the invention.

According to an embodiment of the invention it may be desirable that the monitoring of the lateral displacement is arranged to be symmetric in every direction. Such an embodiment is schematically illustrated in FIG. 4 wherein the planar surface (lined surface in FIG. 4) of the target 124 facing the proximity sensor is arranged to be circle in shape and the central axis of the coil 210 in the proximity sensor is arranged to travel, at least essentially, through the center of the circular surface. The non-limiting embodiment as schematically illustrated in FIG. 4 enables the monitoring of the lateral displacement equally to every direction.

Figure 5A:
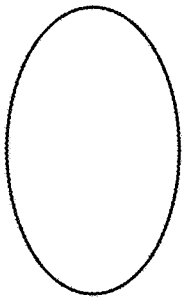
FIGS. 5A-5D illustrate schematically some examples of a target applicable in the invention.
Figure 5B:
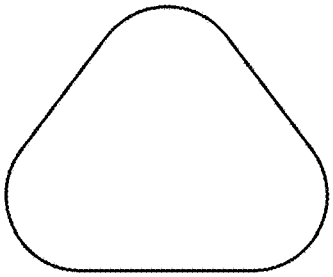
Figure 5C:
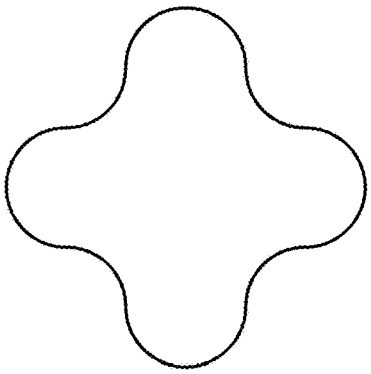
Figure 5D:
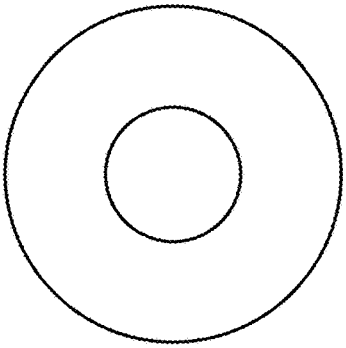

The shape of the planar surface facing the proximity sensor may vary from the circle one as depicted in FIG. 4. For example, in application area wherein the displacement is to be monitored in one direction more closely than in another direction it is possible to select a target with a shape of ellipse. FIGS. 5A-5D schematically illustrates some non-limiting examples of shapes of the planar surface of the target facing the proximity sensor. The shape may e.g. be ellipse (FIG. 5A), rounded triangle (FIG. 5B), rounded cross (FIG. 5C) or toroid shape (FIG. 5D). In order to apply the proximity sensor in the application area of elevator brakes the switching point surface is advantageously continuous. For this reason in the selection of planar surface shape of the target it is essential that a boundary of the planar surface does not comprise sharp corners, but is implemented with rounded shapes. As already mentioned the shape may be selected according to the need in the application area. This may refer, but is not limited to, to a decision that a displacement to some directions is more acceptable than to some other directions.

Next the operation of the arrangement as disclosed is described in more detail. Namely, the proximity sensor 122 and the target 124 mounted to the actuating part i.e. armature part 110 are initially mutually positioned so that the central axis of the coil 210 in the proximity sensor 122 travels, at least essentially, through the center of the circular surface of the target 124. The coil generates the magnetic field when supplied with current which magnetic field travels from a first end of the coil through the metallic target and the air gap back to the other end of the coil 210. The volume of the metallic conductive target material defines, at least partly, the resistance, i.e. reluctance, for the magnetic field. As at least one aim of the present invention is to monitor the operational state of the machinery brake, and specifically to detect permanent changes in the mutual positions of the proximity sensor 122 and the target 124, the target surface is advantageously symmetric and changes in the magnetic field are to be monitored. At some point the magnetic field experienced in the sensor may change due to a change in mutual positions of the mentioned elements. This is because the magnetic field does not travel anymore in the same manner as originally due to displacement that causes an increase in the reluctance of the magnetic circuit. In other words the mutual lateral displacement of the elements is that large that the target does not anymore provide a path for the magnetic field to travel so that the reluctance remains within limits defined by the structure. The change in the magnetic field is detected in the proximity sensor and the sensor changes it state. One additional inventive aspect of the arrangement as described is that when the state of the sensor changes it does not return to the original state at the same displacement point where the change of the sensor state happened if the elements return towards their original positions (i.e. when the sensor was at the first state ("normal state")). This is due to the fact that the coil in the proximity sensor aims to resist the change in the magnetic field. The phenomenon is known as hysteresis. Due to hysteresis in the monitoring arrangement the machinery brake may be driven to a state that it is not allowed to return to operative state without maintenance. The maintenance may comprise an alignment of the frame part and the armature part, with respect to each other, so that the operation of the proximity sensor may be brought to a normal state. Naturally, the alignment may relate to an alignment of the proximity sensor and the target, especially in case if it is concluded that the frame part and the armature part has not laterally displaced with each other. An advantage of the invention is that the monitoring of the elevator brake operation with the proximity sensor as described reveals displacement of the armature part with respect to the frame part, but also if either or both the proximity sensor and the target are displaced. The result is that a need for service is detected.

The operation of the monitoring arrangement may at least partly be adjusted by dimensioning sizes of the coil 210 of the proximity sensor 122 and the target 124 optimally for the application area. According to an embodiment of the invention the optimal dimensioning in the machinery brake may be such that a ratio of an outer diameter of the coil 210 with respect to a diameter of the circular target surface is 1:3. In case the target is not circular, but another shape with rounded shape, such as any of the ones illustrated in FIGS. 5A-5D, the ratio may also advantageously be 1:3 wherein the outer diameter of the coil 210 may be defined with respect to a shortest diameter of target surface. The diameter in this context means a straight line dividing the shape surface into two portions with equal size. The ratio provides flat enough switching point area for the mutual positions of the coil and the target so that random displacement due to e.g. manufacturing tolerances and small mounting errors may be eliminated, but at the same time the monitoring of the operational state may be performed so that a displacement exceeding a predetermined limit is detected.

Figure 6A:
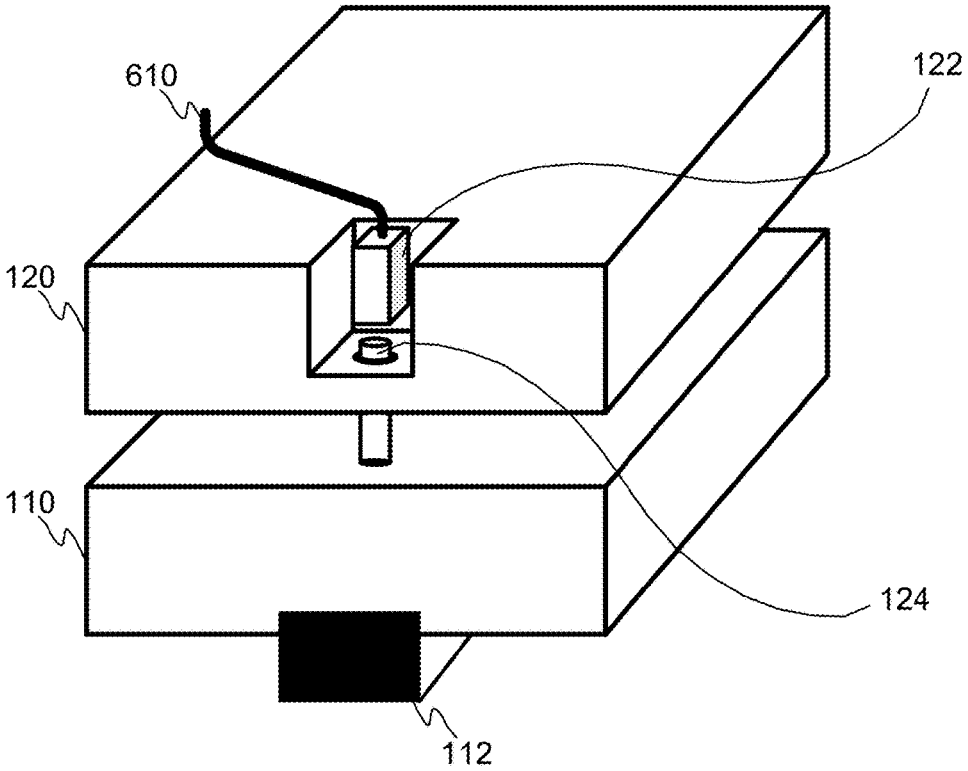
FIGS. 6A and 6B illustrate schematically some embodiments of the invention.
Figure 6B:
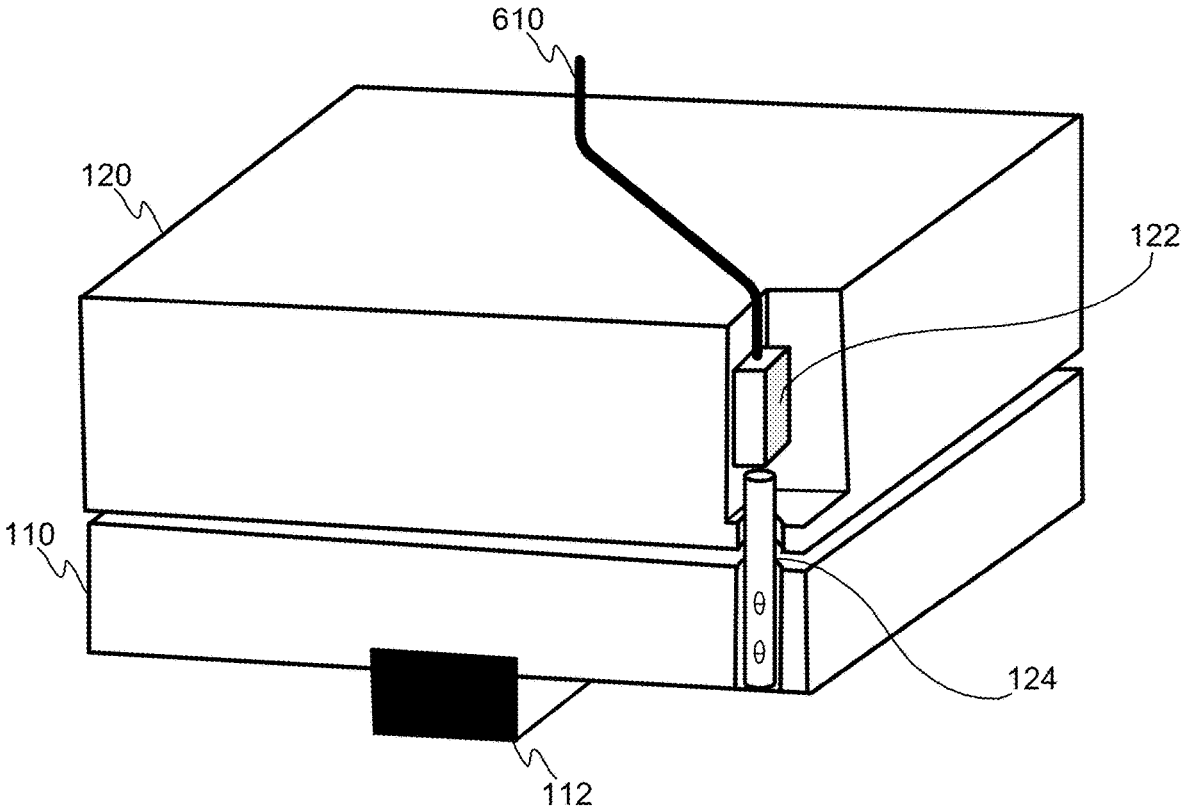

FIGS. 6A and 6B schematically illustrate some examples of a machinery brake used in elevators into which the present invention is implemented. As already described the machinery brake comprises a frame part 120 having an electromagnet inside and an armature part 110. Between the frame part 120 and the armature part 110 are arranged one or more springs to take the mentioned parts apart from each other when braking (the springs are not shown in FIGS. 6A and 6B). During the braking a brake shoe 112 mounted together with the armature part 110 is arranged to hit a rotating part of an elevator hoisting machine. A release of the brake is achieved by providing current to the electromagnet and by controlling the current it is possible to control the braking force. The frame part 120 may also comprise a proximity sensor 122 that comprises a coil in it. A current may be supplied with a cable 610 traveling along the frame part 120. According to an embodiment of the invention the proximity sensor 122 is mounted in an aperture arranged in the frame part 120. A target 124, such as a plunger, is, according to an embodiment, mounted to the armature part 110 and arranged to reach, along the movement of the armature part 110, an operational area of the proximity sensor 122 through a through hole arranged in the frame part 120 (see the embodiment shown in FIG. 6A). Alternatively, the target 124 may be mounted to an outer surface of the armature part 110 and, thus, no through hole is needed in the frame part 120 (see the embodiment shown in FIG. 6B). The operational area of the proximity sensor 122 refers to a positioning of the sensor 122 with respect to the target so that it is possible to detect the normal state and an abnormal state of the machinery brake as described. As mentioned above according to an embodiment of the invention the target 124 may be brought to the operational area of the sensor through an open aperture, i.e. not through a hole. According to still further embodiment the proximity sensor and the target may be mounted to outer sides of the frame part and the armature part, correspondingly, so that no apertures are needed. The inventive idea is not limited to the described embodiments, but e.g. the positioning of the target 124 and the proximity sensor 122 may vary.

An aspect of the present invention is that the coil in the proximity sensor and a coil of the electromagnet residing in the frame part preferably does not interfere each other. The interference may be mitigated by optimal selection of the proximity sensor so that a frequency of the magnetic field generated by the coil in the proximity sensor differs from any other magnetic field frequency existing in the environment of the machinery brake. For example, it is possible to optimize the operation of the electromagnet in the frame part 120 so that the operation does not generate frequencies overlapping the operational frequency of the proximity sensor. For example, the operational frequency of the proximity sensor 122 may e.g. be >100 kHz, whereas the frequencies of the magnetic fields originating from machinery brake, due to disturbances among other, remain <50 KHz.

Figure 7:
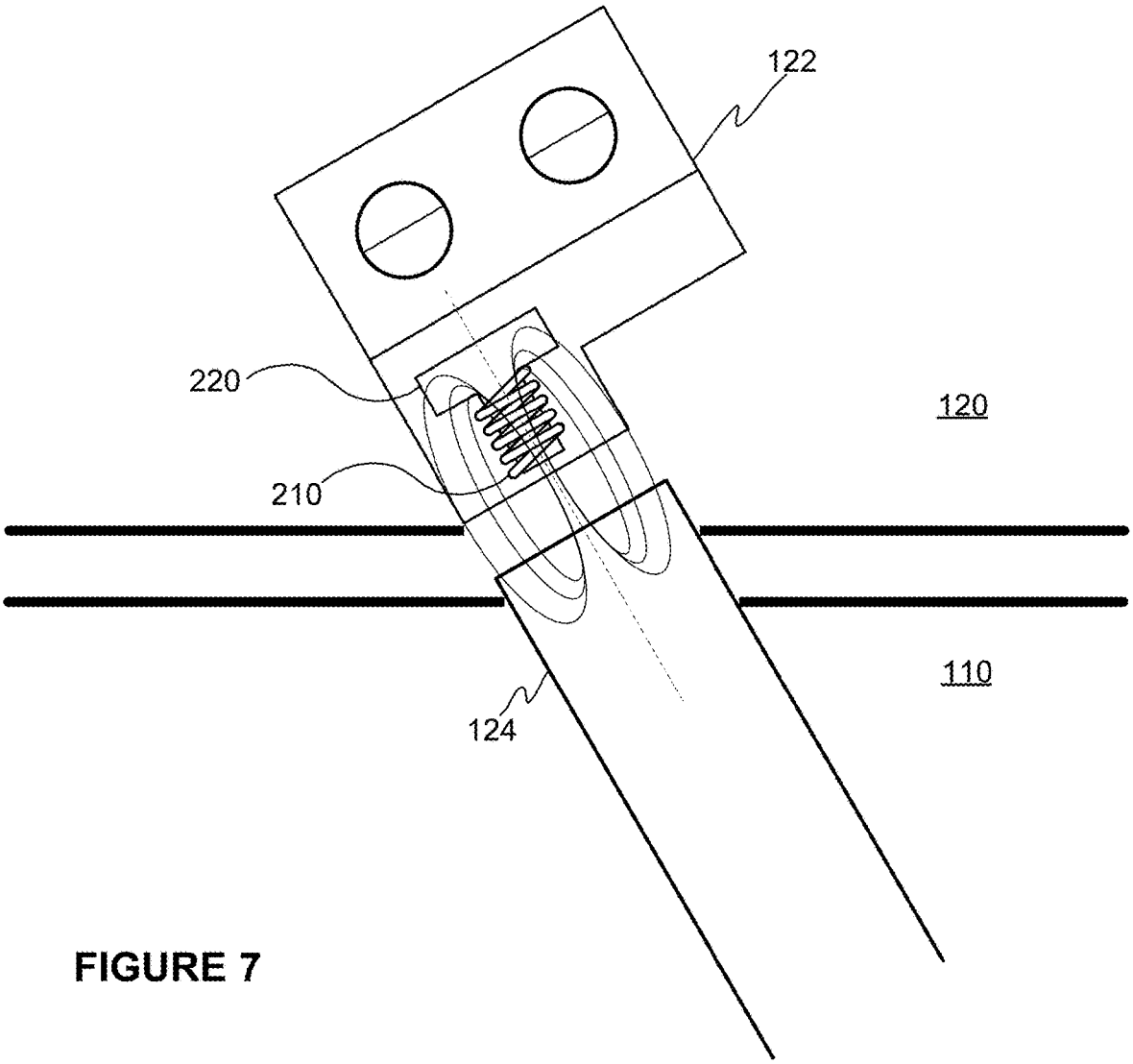
FIG. 7 illustrate schematically some aspects of a further embodiment of the invention.

Some further embodiment of the present invention may be implemented so that the proximity sensor 122 and the target 124 are mounted in a slanted position with respect to an axis of motion of the armature part 110. More specifically, the central axis of the coil 210 in the proximity sensor 122 travels slanted with respect to the axis of a normal motion of the armature part 110 i.e. wherein the armature part 110 is configured to move essentially along a normal of the surface of the armature part 110 facing the frame part. Such an implementation is schematically illustrated in FIG. 7. An advantage of this kind of mounting arrangement is that the operation of the present invention is enhance when the distance of motion of the armature part 110 with respect to frame part 120 is small. Then, any un-allowed lateral displacement may be detected efficiently with the slanted positioning.

The embodiments as described above are implemented so that the proximity sensor 122 is mounted in the frame part 120 and the target is mounted, or arranged, in the armature part 110 of the machinery brake. However, the inventive idea of the present invention may also be applied so that the proximity sensor 122 is mounted in the armature part 110 and the target 124 is mounted in the frame part 120. In such an implementation the cable supplying current to the proximity sensor 122 shall be brought to the sensor so that arrangement enable the movement of the armature part 110 in such a manner that the cable does not prevent the motion nor it is possible that the cable, or any part of it, ends up to any un-allowed location, such as between the frame part and the armature part, in the machinery brake. Hence, the mounting arrangement of the cable is important. Alternatively or in addition, the cable shall be protected so that it may stand the stress caused by the motion.

As already mentioned the target material shall be made of conductive metal. Advantageously, the target for the proximity sensor is a flat piece of ferrous metal, but non-ferrous metals may also be used. Generally speaking some non-limiting examples of the target materials may be: steel (Fe360), stainless steel, aluminum, brass, copper. Especially, in elevator environment and in the application area of machinery brakes for elevators, ferromagnetic material is used as the target material at least partly, such as coated with the ferromagnetic material. This is due to the fact that as the ferromagnetic material maintains the magnetic characteristic it has a further effect in the elevator environment. Namely, they may collect at least part of the dust from the elevator shaft around the target. That forms a protection layer to the target against other dirt ending up between the target and the proximity sensor. Hence, the operation of the present invention is also improved by using the ferromagnetic material as the target material, such as iron or any other applicable.

The proximity sensor and the target may be mounted to the entities, such as to the frame part or to the armature part, with any known method. For example, any applicable mounting device, such as screw, bolt or similar may be used. As well, gluing, welding or any similar may be used either both or one of the mountable parts.

Some aspects of the invention relate to a method for monitoring an operational state of a machinery brake of an elevator, wherein the machinery brake comprises a frame part 120 comprising an electromagnet and an armature part 110. In the method an output signal of an inductive proximity sensor 122 is monitored. The inductive proximity sensor 122 is mounted either to the frame 120 part or the armature part 110. The output signal of the inductive proximity switch is dependent on a mutual position of the inductive proximity sensor and a target 124 that is mounted to the other of the frame part 120 or armature part (110) i.e. to the other of the one into which the sensor 122 is mounted to. According to the method, in response to detection that the output signal of the inductive proximity sensor 122 is changed a control unit of the machinery brake is configured to generate an alarm signal.

As described the proximity sensor generates an output signal having typically two states. The solution according to the invention is based on an idea that when the machinery brake operates normally, i.e. the parts of the machinery brake are mutually positioned in an acceptable way, the proximity sensor is configured to generate a first output signal. In case the proximity sensor changes its state due to a change in mutual positions of the parts exceeding the limit defined by the arrangement according to the invention the proximity sensor is configured to generate a second output signal. A control unit may be configured to monitor the output signal and in response to a detection of a change from the first output signal to a second output signal the control unit may be configured to perform predetermined tasks. The predetermined tasks may e.g. comprise, but are not limited to, one or more of the following: controlling of operation of the elevator, controlling of a maximum travel speed of the elevator, controlling of access to the elevator.

The monitoring of an operational state of the machinery brake comprises at least to detecting with sensor arrangement if the machinery brake is operating normally or if it is misoperating. The misoperation may e.g. be due to misalignment, or un-allowed displacement, of parts of the machinery brake with respect to each other.

The specific examples provided in the description given above should not be construed as limiting the applicability and/or the interpretation of the appended claims. Lists and groups of examples provided in the description given above are not exhaustive unless otherwise explicitly stated.

What is claimed is:

1. A machinery brake for an elevator, wherein the machinery brake comprises:

a frame part comprising an electromagnet;

an armature part;

an inductive proximity sensor mounted to one of the frame part and the armature part; and a target mounted to the other of the frame part and the armature part, wherein the inductive proximity sensor and the target are mounted with respect to each other so that in a normal state of the machinery brake the target resides within an operational area of the inductive proximity sensor and in an abnormal state of the machinery brake the target resides at least partly outside the operational area of the inductive proximity sensor, wherein the target residing at least partly outside the operational area of the inductive proximity sensor in the abnormal state of the machinery brake includes a lateral displacement, in a direction perpendicular to an axial direction of a coil of the inductive proximity sensor, of the target with respect to the inductive proximity sensor.

2. The machinery brake as claimed in claim 1, wherein the proximity sensor is configured to generate a first output signal when the machinery brake is in the normal state and a second output signal when the machinery brake is in the abnormal state.

3. The machinery brake as claimed in claim 1, wherein the target comprises a planar surface facing the proximity sensor and wherein the planar surface is arranged perpendicularly to a center axis of the coil in the proximity sensor.

4. The machinery brake as claimed in claim 3, wherein a boundary defining the planar surface of the target comprises rounded shapes.

5. The machinery brake as claimed in claim 4, wherein the planar surface is a circle.

6. The machinery brake as claimed in claim 3, wherein a ratio of an outer diameter of the coil with respect to a shortest diameter of the planar surface is 1:3.

7. The machinery brake as claimed in claim 1, wherein the inductive proximity sensor and the target are mounted so that a direction of a central axis of the coil residing in the inductive proximity sensor deviates from a normal of a surface of the armature part facing the frame part.

8. The machinery brake as claimed in claim 1, wherein the target is brought to the operational area of the inductive proximity sensor through a through hole arranged in the part into which the inductive proximity sensor is mounted to.

9. The machinery brake as claimed in claim 1, wherein the target is at least partly made of ferromagnetic material.

10. The machinery brake as claimed in claim 1, wherein the machinery brake further comprising a control unit that is configured to generate an alarm signal in response to a detection that the machinery brake is in the abnormal state.

11. A method for monitoring an operational state of a machinery brake of an elevator, wherein the machinery brake comprises an armature part and a frame part comprising an electromagnet, the method comprising:

monitoring an output signal of an inductive proximity sensor that is mounted to one of the frame part and the armature part, wherein the output signal is dependent on a mutual position of the inductive proximity sensor and a target mounted to the other of the frame part and the armature part; and in response to detection that the output signal of the inductive proximity sensor is changed, configuring a control unit of the machinery brake to generate an alarm signal, wherein the output signal of the inductive proximity sensor is changed when the target resides at least partly outside an operational area of the inductive proximity sensor which indicates an abnormal state of the machinery brake, and wherein the target residing at least partly outside the operational area of the inductive proximity sensor in the abnormal state of the machinery brake includes a lateral displacement, in a direction perpendicular to an axial direction of a coil of the inductive proximity sensor, of the target with respect to the inductive proximity sensor.

12. The machinery brake as claimed in claim 2, wherein the target comprises a planar surface facing the proximity sensor and wherein the planar surface is arranged perpendicularly to a center axis of the coil in the proximity sensor.

13. The machinery brake as claimed in claim 4, wherein a ratio of an outer diameter of the coil with respect to a shortest diameter of the planar surface is 1:3.

14. The machinery brake as claimed in claim 5, wherein a ratio of an outer diameter of the coil with respect to a shortest diameter of the planar surface is 1:3.

15. The machinery brake as claimed in claim 2, wherein the inductive proximity sensor and the target are mounted so that a direction of a central axis of the coil residing in the inductive proximity sensor deviates from a normal of a surface of the armature part facing the frame part.

16. The machinery brake as claimed in claim 3, wherein the inductive proximity sensor and the target are mounted so that a direction of a central axis of the coil residing in the inductive proximity sensor deviates from a normal of a surface of the armature part facing the frame part.

17. The machinery brake as claimed in claim 4, wherein the inductive proximity sensor and the target are mounted so that a direction of a central axis of the coil residing in the inductive proximity sensor deviates from a normal of a surface of the armature part facing the frame part.

18. The machinery brake as claimed in claim 5, wherein the inductive proximity sensor and the target are mounted so that a direction of a central axis of the coil residing in the inductive proximity sensor deviates from a normal of a surface of the armature part facing the frame part.

19. The machinery brake as claimed in claim 1, wherein the frame part has a surface, the armature part has a surface facing the surface of the frame part with a gap therebetween, and the target extends from said the other of the frame part and the armature part into said one of the frame part and the armature part by passing said gap into a through hole formed in the surface of said one of the frame part and the armature part into which the inductive proximity sensor is mounted.

20. The machinery brake as claimed in claim 1, wherein the inductive proximity sensor includes a coil, the target includes a planar surface facing the inductive proximity sensor, and a center axis of the coil is aligned with a center axis of the planar surface, which is normal to the planar surface of the target, in the normal state of the machinery brake.

* * * * *